United States Patent [19]

Cox

[11] 4,436,003

[45] Mar. 13, 1984

[54] TOOL FOR SUPPORTING AND TURNING THREADED MEMBERS

[76] Inventor: Raymond G. Cox, 733 Cumberland Dr., St. Louis, Mo. 63125

[21] Appl. No.: 337,583

[22] Filed: Jan. 7, 1982

[51] Int. Cl.[3] ..... B25B 13/00

[52] U.S. Cl. ..... 81/57.43; 81/57.3; 81/57.46

[58] Field of Search ..... 81/57.3, 57.43, 57.46, 81/64, 13

[56] References Cited

U.S. PATENT DOCUMENTS

| | | | |
|---|---|---|---|
| 2,357,595 | 9/1944 | McPherson | 81/57.43 |
| 2,603,998 | 7/1952 | Schwartz | 81/57.43 |
| 2,722,148 | 11/1955 | Woyton | 81/13 |
| 3,283,621 | 11/1966 | Faso | 81/57.3 |

FOREIGN PATENT DOCUMENTS

| | | | |
|---|---|---|---|
| 870344 | 5/1971 | Canada | 81/57.3 |

*Primary Examiner*—James L. Jones, Jr.
*Attorney, Agent, or Firm*—Haverstock, Garrett & Roberts

[57] ABSTRACT

A tool having particular utility for supporting for rotation threaded members to be installed or removed from relatively inaccessible locations comprising an elongated body member having an opening extending therethrough and a portion on one end thereof for supporting a threaded member positioned thereagainst, at least one flange member extending endwardly from the opposite end portion of the body member for rotatably mounting a wheel member thereon, a flexible member of suitable length extending through the opening formed in the body member and having its opposite end portions extending respectively from opposite ends thereof, one end portion of the flexible member being engagable with the opposite sides of the wheel member, the opposite end portion of the flexible member being engagable with the threaded member being supported by the supporting portion such that when the flexible member is engaged with the threaded member and with the opposite sides of the wheel member, rotation of the wheel member will move the flexible member longitudinally through the body member and impart rotational movement to the threaded member.

11 Claims, 10 Drawing Figures

36
30
16
19
18
19
14
30
12
31

10
5
5
12
14
21
34
19
16
20
32
26
28
30

32
30
31
34

TOOL FOR SUPPORTING AND TURNING THREADED MEMBERS

The present invention relates to a wrench type tool for supporting and turning threaded members during threading and unthreading operations and, more particularly, to a tool that can be conveniently employed as a means for starting, removing or replacing nuts and bolts where the compactness of the mechanical system involved and the inaccessibility of parts due to space limitations make accessibility difficult if not almost impossible.

A common and frustrating problem encountered by mechanics and others involves the installation and/or removal of threaded members which are located in positions where the space limitations and system compactness of the particular apparatus involved make accessibility by hand or by conventional tools extremely difficult, if not impossible. Many different kinds of tools are known and have been employed for use in supporting and rotating a fastening member in such inaccessible locations. Such known starting tools teach a wide variety of constructions, most of which include a nut or bolt engaging member attached to a bendable or flexible shaft such that the tool can be employed and manipulated for use in engaging nuts and bolts which are awkwardly positioned in such relatively compact locations. Typical of such known constructions are the tool devices disclosed in U.S. Pat. Nos. 1,903,660; 2,372,930; 2,619,860; 2,704,005; 2,814,224; 3,507,172; and in French Pat. No. 872,798. Other known constructions utilize an open-ended flexible cable or the like to encircle and rotate the nut or bolt to be fastened or unfastened in order to effect the threading operation. See for examples the constructions disclosed in U.S. Pat. Nos. 2,357,595 and 3,124,983. Still other known constructions utilize an open-ended flexible band member attached to a pull knob assembly for reciprocable longitudinal movement through a substantially U-shaped path around a nut supporting member to impart rotational movement to the nut placed therein. See for example the construction shown in U.S. Pat. No. 3,200,676. In certain other constructions there is also provided a mechanical linkage operatively connecting a rotatably mounted disc member to a nut-holding socket member such that rotation of the disc member produces rotation of the nut-holding socket member. See for example the construction disclosed in U.S. Pat. No. 2,491,133.

While various types of tools have been devised to support and rotate a nut and/or a bolt in such inaccessible locations for accomplishing the installation and/or removal thereof, all such prior art devices suffer from certain disadvantages and shortcomings. For example, the known constructions for the most part are characterized by complicated and cumbersome mechanisms which are relatively difficult to manipulate and maneuver, especially with one hand, in order to properly effect rotational movement of the nut or bolt to be threaded and/or unthreaded; many constructions do not allow the user to rotate a particular nut or bolt through any number of desired revolutions to permit threading of such nut or bolt onto or off of its corresponding member, but instead, limit the total amount of possible rotations of the threaded member involved; and many such tools are adaptable for use only with a particular size nut and are not adaptable for rotatably supporting almost any size nut and/or bolt or other fastening members as is true of the present device. In addition, many devices utilize nut-engaging support means, the size of which limits or prevents its usefulness in extremely compact locations. None of the known devices provide simple means on the tool for rotatably supporting threaded members of various sizes when positioned thereon; none utilize a continuous flexible belt-like member of high friction material which extends through the tubular body portion of the tool and from both ends thereof for imparting rotational movement to the fastening member through any amount of rotation or number of desired revolutions when properly manipulated; and none utilize a knurled wheel member rotatably mounted at the rear accessible portion of the device for engaging the belt-like member and providing the means for controllably tensioning and moving the belt member in the desired direction of movement longitudinally through the body portion of the device. For these and other reasons, the known constructions have not been entirely satisfactory and have generally enjoyed limited usefulness.

The present device overcomes these and other shortcomings and disadvantages associated with the known starter type tool devices and teaches the construction and operation of a relatively simple, more efficient device for starting the loosening the threading operation of a nut, bolt, or any other type of fastening member which can be conveniently employed in many mechanical systems where, due to limitations of space and size, the location of nuts and bolts are awkwardly positioned. In its preferred embodiment, the present tool is comprised of an elongated tubular member having a flange portion extending endwardly from one end portion thereof which is preferably integral with the sidewall of the tubular member. The flange portion preferably includes a small projection extending sidewardly therefrom in position to rotatably support a nut and/or bolt when positioned thereon or thereagainst. The projection is dimensioned so as to accommodate threaded members of various sizes and may be magnetized so that a conventional nut or bolt may be easily positioned and retained thereon, therearound or thereagainst. The opposite end of the elongated tubular member includes a pair of spaced opposed flanges defining a channel therebetween which communicates with the passageway through the tubular member. A knurled wheel member is rotatably mounted in the channel between the opposed flanges by any suitable means. An endless flexible belt member preferably having high friction surface characteristics on at least one side and being of suitable length extends through the tubular member and has end portions that extend from both opposite ends thereof. One end portion of the belt member is positioned extending on opposite sides of the knurled wheel member and the opposite end thereof extends around the projection and around a nut or bolt positioned in communication therewith. The belt member may be constructed of any suitable material such as of a rubber-like material or some other suitable flexible material, preferably with a high friction material on at least one surface thereof.

Once a threaded member is positioned on, around or against the projection associated with the endwardly extending flange portion, the adjacent end portion of the belt member is drawn taut therearound with the high friction material against the threaded member. While the threaded member is thus held, it is moved adjacent to and placed in operative engagement with its cooperating fastening member on which or into which it will be attached. The flexible belt member is thereafter pressed against the opposite sides of the knurled wheel member by finger and thumb pressure and is then rotated to move the reaches of the belt in opposite directions longitudinally through the tubular portion of the device. Movement of the belt member in the desired direction imparts a rotary motion to the fastening member.

The present tool can be dimensioned and constructed so as to conform to almost any nut or bolt size, and it can be made to be straight, formed at an angle, or curved, and the nut or bolt communicating portion can be constructed of a flexible material to further facilitate use in relatively inaccessible areas. Various embodiments disclose use of a variety of means for rotatably supporting a fastening member thereon. It should be noted that the primary use and function of the present device is for starting or loosening the threading operation of a nut or bolt. The present tool is not, however, designed to finally torque the threaded member into its final position or to loosen a torqued threaded member. Although it is anticipated that the present device will be used primarily when working on mechanical devices such as vehicle engines and the like, the subject tool can also be employed on many systems and machines where, due to limitations of size and space, access to nuts and bolts for starting and removing them is difficult and awkward. Typical applications include: threaded members used on automobile engines, motorcycle engines, aircraft engines, auxiliary power units, various machine tools, and other similar equipment.

It is therefore a principal object of the present invention to provide a simple, efficient tool for starting, removing or replacing nuts, bolts, and other types of threaded fastening members where space limitations and system compactness make accessibility difficult.

Another object is to provide a starting tool device which a user can easily manipulate and operate even with only one hand.

Another object is to provide a tool for starting and removing threaded members which allows the user to rotate a particular nut or bolt through any desired rotation that is necessary so as to permit the threading or unthreading of the nut or bolt.

Another object is to provide a tool which is easy to manipulate into position to attach to or separate from a threaded member to be rotated thereby.

Another object is to teach the construction and operation of a tool which utilizes a continuous flexible belt-like member in conjunction with a rotatably mounted wheel member to effect rotational movement of a fastening member.

Another object is to provide a tool for rotating threaded members which can be dimensioned and constructed so as to conform to and accommodate threaded members of varying sizes.

Another object is to provide relatively simple means to support a threaded member for rotation so that it can be installed at or removed from an otherwise inaccessible location.

Another object is to reduce the amount of time and effort required to install and remove or replace threaded members at locations that are difficult to get to.

Another object is to provide a tool having means on one end for rotatably supporting and retaining threaded members of various sizes.

Another object is to provide an elongated tool having an endless flexible belt extending therethrough and from opposite ends thereof, one end of which has means for rotatably supporting a member to be rotated and the opposite end having rotatable means engagable by the belt to apply controlled tension and movement thereto.

Another object is to provide a relatively simple inexpensive tool construction for supporting threaded members for rotation which tool is lightweight, durable, and requires relatively little maintenance.

Another object is to teach the construction and operation of a starting type tool device which has maximum adaptability and versatility with respect to varying positions of operations.

Another object is to teach the construction and operation of a tool device which enables a user to controllably remotely support and rotate a nut or bolt in either direction.

These and other objects and advantages of the present invention will become apparent to those skilled in the art after considering the following detailed specification of several different embodiments of the present device in conjunction with the accompanying drawings, wherein.

Figure 1:
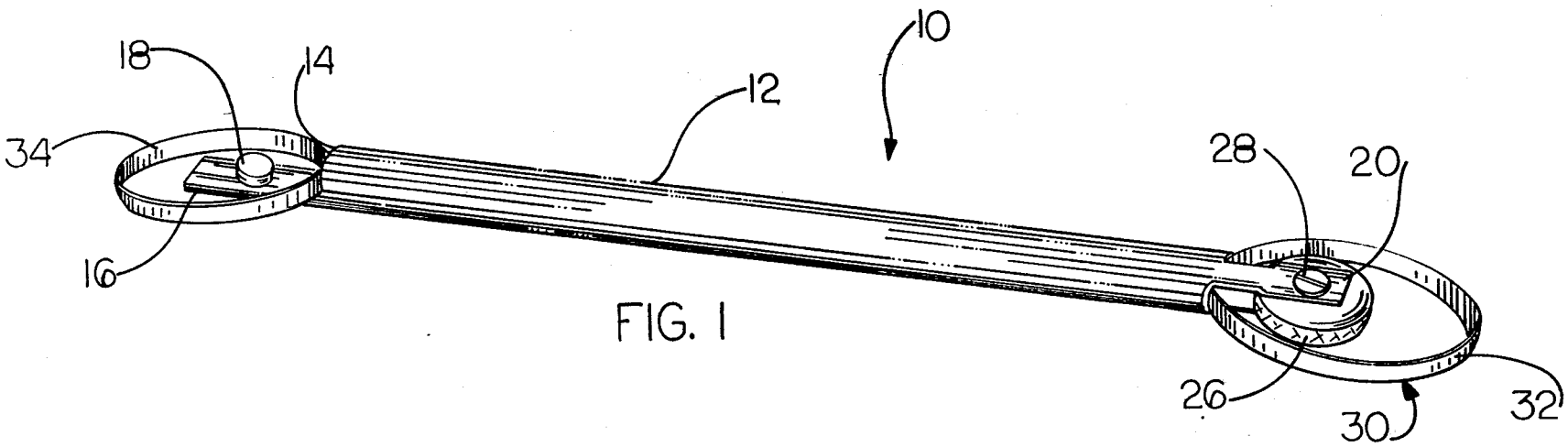
FIG. 1 is a perspective view of one embodiment of a tool device constructed according to the teachings of the present invention.
Figure 2:
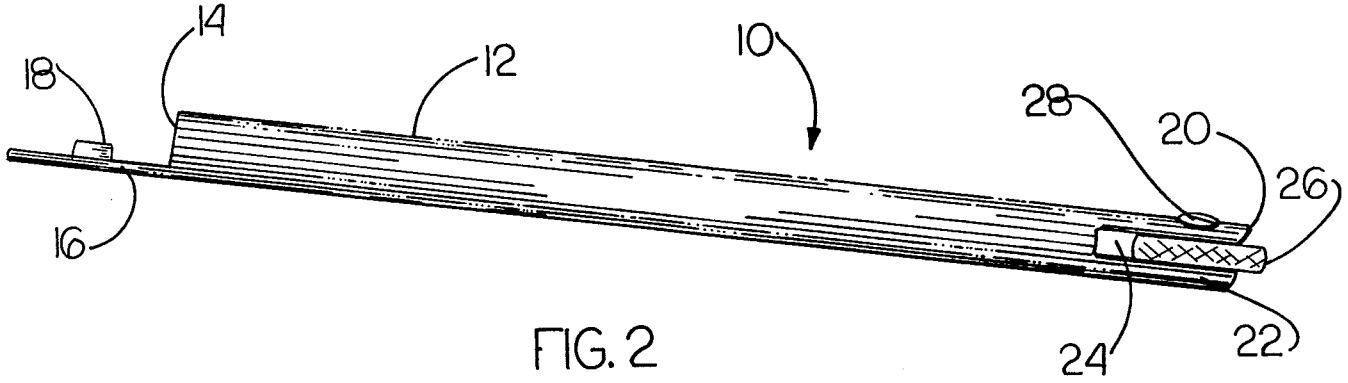
FIG. 2 is a side elevational view of the tool device of FIG. 1, but without the flexible belt-like member.
Figures 3, 4, 5:
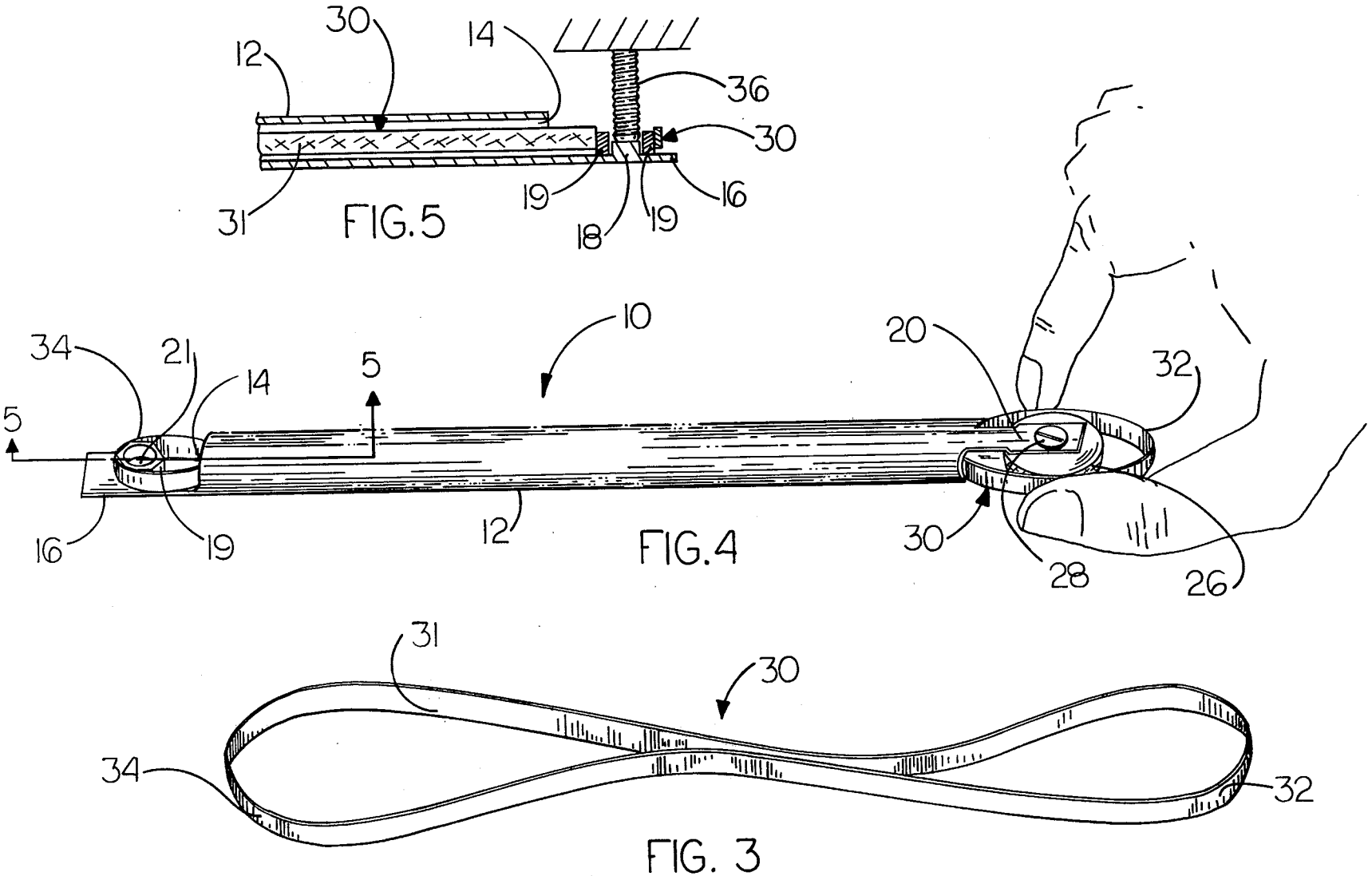
FIG. 3 is a perspective view of the flexible belt-like member utilized in the present tool device.
FIG. 4 is a perspective view illustrating the operation of the present tool device.
FIG. 5 is an enlarged fragmentary cross-sectional view taken along the line 5—5 of FIG. 4 illustrating one application and use of the present tool device.

Referring to the drawings more particularly by reference numbers wherein like numerals refer to like parts, number 10 in FIGS. 1, 2 and 4 identifies one embodiment of a tool constructed according to the present invention. The tool 10 is primarily adaptable for holding and supporting nuts such as hexagonal threaded nuts and includes an elongated tubular member 12 having an opening or pasageway 14 extending therethrough. A flange 16 extends endwardly from one side of the tube 12 as shown in FIGS. 1 and 2. The flange 16 is preferably formed as an integral extension of the sidewall of the tubular member 12 and carries a sidewardly extending projection 18 in position to rotatably hold and support a nut thereon. Preferably, the projection 18 is dimensioned such that the threaded opening of a nut will easily fit over and around the projection 18 in such a manner that when a nut such as the nut 19 (FIG. 4) is positioned thereon, it can be easily rotated. Where the diameter of the threaded opening 21 of the nut 19 is greater than the diameter or cross-sectional size of the projection 18, the projection 18 extends into the opening 21 of the nut 19 and engages the sidewalls thereof thereby holding and retaining the nut 19 adjacent to the flanges 16 while said nut is being placed into threaded engagement with its mating fastener member. In this situation, the projection 18 also facilitates the holding of the nut 19 against the flange 16 while it is being rotated thereabout through engagement with the flexible belt 30 as will be hereinafter explained.

In those situations where the diameter of the threaded opening 21 of the nut 19 is less than the diameter or cross-sectional size of the projection 18, it is also possible to support and hold the nut 19 directly on the projection 18 such that when the belt member 30 is drawn taut therearound as will be explained, the tool 10 can be positioned and manipulated so as to maintain and hold the nut 19 in proper position thereon until placed in communication with its corresponding mating fastener member. Once placed in communication with its mating fastener member, the manual force exerted against the nut in order to hold it in communication with its mating member will be sufficient to hold the nut on the projection 18 while it is being rotated thereon as explained below. In this situation, where the cross-sectional size of projection 18 is greater than the threaded opening of the nut placed thereon, it is generally preferred that the projection 18 be constructed of a magnetized material such that a nut may be positioned and easily retained anywhere thereon. This greatly facilitates holding of the nut on the projection 18 while the nut is being placed into threaded engagement with its corresponding mating member and while the nut is being rotated thereon. In addition, this also enables the tool 10 to adequately hold and support other fastener members, such as bolts, while said members are being placed in communication with their corresponding mating members. In the case of holding and supporting a bolt on the magnetized projection 18 during threading and unthreading operations, the manual force exerted against the bolt in order to hold it in communication with its corresponding threaded member should likewise be sufficient to hold the bolt in proper position on the projection 18 while it is being rotated thereon.

The opposite end portion of the elongated tubular member 12 is shown including a pair of spaced opposed flanges 20 and 22 defining a space 24 therebetween which communicates with the passageway 14 formed within the tubular member 12. Like the flange portion 16, it is generally preferred that the opposed flange members 20 and 22 be integrally formed as extensions of the sidewall of the tubular member 12, although any suitable means for attaching the same may be utilized. A knurled wheel member 26 is rotatably mounted in the space 24 between the opposed flanges 20 and 22 by any suitable means such as by a shaft or by the threaded member 28. Although the opposed flanges 20 and 22 are generally preferred, it is also contemplated that any other suitable means may be utilized for rotatably mounting the wheel member 26 adjacent to the rear portion of the tubular member 12 as shown in FIGS. 1 and 2 such as by using a single flange member (not shown), similar to flange member 16, extending endwardly from the rear portion of the tube 12. A belt member such as the endless belt 30 (FIG. 3) preferably having high friction surface characteristics on at least its inner surface, such as the surface 31, and being of suitable length extends through the passageway 14 of the tubular member 12 and from both opposite ends thereof. The ends of the belt 30 are identified as belt portions 32 and 34 but these portions will change as the tool is used. The end portion 32 of the belt 30 is shown positioned to engage the opposite sides of the rotatable wheel member 26 and the opposite end portion 34 is shown extending around the small projection 18 and around a fastening member positioned thereon. The belt member 30 may be constructed of any suitable material such as a rubberized belting material that is relatively flexible and preferably has a high friction gripping surface.

FIG. 4 illustrates operation of the tool device 10. A nut such as the nut 19 is positioned on the projection 18 associated with the flange portion 16 and the adjacent belt end portion 34 is drawn relatively taut around the nut 19 by pulling on the opposite belt end portion 32 to maintain and hold the fastener 19 in proper position thereon. The tool is then manipulated to place the fastener 19 in communication with another threaded member to which or from which the fastener is to be attached or removed. Since the nut 19 is in proper position and while maintaining the reaches of the belt pressed by the thumb and forefinger against the opposite sides of the knurled wheel member 26, it is then possible, while maintaining tension on the belt, to rotate the wheel 26 in the desired direction. In this way the nut 19 is rotated by engagement with the moving belt 30 to cause the desired connection or removal to be made. It is important to note that a user can easily hold the required tension on the belt 30 by applying pressure to or otherwise pulling the belt end portion 32 about the outermost end portion of the wheel member 26 as shown in FIG. 4. This enables a user to easily maintain the fastener 19 in proper position on the tool 10 and also makes the tool easy to manipulate, especially with one hand. It is also preferred that at least the inner surface 31 of the belt 30 have high friction gripping characteristics to improve its gripping action and facilitate the rotational movement of the nut 19 or any other fastener. Once the nut 19 is initially threaded onto a mating member, a conventional wrench or other tool may be utilized for finally threading and torquing the nut 19. A conventional tool must also be utilized to initially untorque a fastener member to be removed. It is important to recognize that with the subject tool it is possible to start or remove a loosened threaded member from a remote location such as a location deep within an engine or machine and to do so while firmly supporting the threaded member for rotation. The only practical limitation on the subject tool is in the length that the user can handle.

FIG. 5 illustrates a typical application of the present device 10. The threaded nut 19 is shown positioned on the projection 18 and is adjacent to the end of a mating threaded member such as the threaded member 36. As illustrated, the belt member 30 has been drawn taut around the nut 19 such that when the opposite reaches of the belt member 30 are moved longitudinally in opposite directions through the passageway 14 of the tubular member 12, rotational movement will be imparted to the nut 19 causing the nut 19 to be threaded onto or off of the member 36.

Use of the continuous or endless belt member 30 for effecting the rotational movement of the fastening member to be threaded or unthreaded is important to the present invention because this means that the fastening member can be rotated as much as desired and in the desired direction to initially thread it onto or finally remove it off of some other mating member as illustrated in FIG. 5. This is also important because it enables a user to easily manipulate and operate the subject device with only one hand (FIG. 4) and it allows the user to rotate a particular fastener member through any desired number of rotations, a feature not possible with the known constructions. In addition, the projection 18 may be dimensioned and constructed so as to conform to and accommodate almost any size threaded member. This is important because it enables an operator to use the tool 10 with threaded members of varying sizes without exchanging and/or adding additional parts to the tool in order to accomplish the same. Additionally, constructing the projection 18 out of a magnetized material would further facilitate use of the subject device in relatively compact areas for rotatably supporting and holding threaded members of various sizes when positioned thereon.

Figure 8:
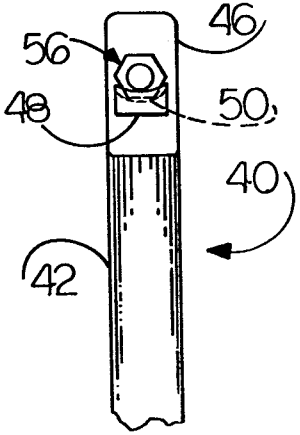
FIG. 8 is an enlarged top plan view of the tool device of FIG. 6 or 7.
Figure 7:
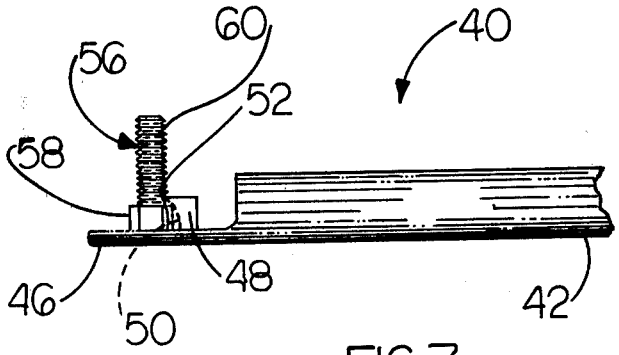
FIG. 7 is an enlarged side elevational view of the tool device of FIG. 6, but showing a different form of threaded fastening member supported thereon.
Figure 6:
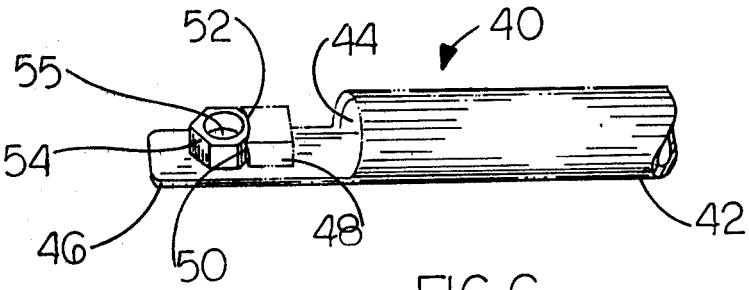
FIG. 6 is an enlarged fragmentary perspective view of one end portion of another embodiment of the present tool device showing other means for rotatably supporting a fastening member thereon.

FIGS. 6–8 disclose another embodiment 40 of the present tool device wherein a modified form of the projection 18 (FIGS. 1 and 2), namely, projection 48, is utilized for rotatably supporting and holding a fastening member in proper position on the subject device until the threading or unthreading operation is completed. The embodiment 40 is specifically adaptable for use with both nuts as well as with bolts such as the nut 54 (FIG. 6) and the bolt 56 (FIG. 7). The device 40 includes an elongated tubular member 42 having an opening or passageway 44 extending therethrough and a flange 46 extending endwardly from one end thereof as in the construction 10 described above. The components comprising the opposite end of the tool 40 can likewise be constructed and arranged similarly to corresponding portions of the device 10. In the embodiment 40, the end facing surface of the projection 48 is recessed as at 50 to rotatably receive and sufficiently hold a fastening member. The recessed end surface 50 is preferably concaved or otherwise rounded in both planar directions, namely, vertically and laterally, to form an overhang as at 52 to hold a threaded member against the flange 46. Once a portion of a fastening member 54 is positioned in engagement with the recessed surface 50 and with the adjacent end portion 34 of the belt 30 drawn taut therearound, movement of the belt will produce rotational movement of the threaded fastener. The tension on the belt will also hold the fastener on the tool. It should be recognized that a threaded fastener can be installed on the tool ahead of time when the fastener is to be started into engagement and it is equally possible to manipulate the tool into engagement with a threaded fastener that is to be removed by unthreading it. The subject tool can be easily attached to or removed from a threaded member into a remote location by simply loosening the belt 30 to form a loop such as the looped end portion 34 shown in FIG. 1 and thereafter pulling it taut around the threaded member as shown in FIG. 4. In either case, the subject tool will hold the fastener and keep it from falling loose and being dropped or lost.

In the construction of the projection 48, it is important that the recessed end portion 50 be formed and shaped such that the fastening member placed thereagainst will be allowed to freely rotate therewithin without substantial interference from either the sidewalls of the recessed portion 50 or the overhanging of the flange 52. For this reason, it is generally preferred that the end portion 50 be concaved or otherwise rounded as shown in FIGS. 6–8 since this provides the least resistance to rotation of the fastening member and many different sized fasteners can be accommodated against the same surface 50. In addition, the rounded configuration of the end surface 50 in conjunction with the belt 30 which extends around a substantial portion of the fastening member limits and restricts lateral movement of the fastening member which might otherwise occur during a threading or unthreading operation. Additionally, the overall height of the projection 48 should be dimensioned such that it will accommodate a range of nut and bolt sizes. The overhang 52 therefore serves to minimize any vertical displacement of the fastener which might otherwise occur during installation and/or removal thereof. It is also important that the overhang 52 not extend endwardly so far as to unduly interfere with or come into contact with the threaded portion of a bolt nor should it extend over the threaded opening of a nut for obvious reasons. The projection 48 should be dimensioned so as to conform to and accommodate the desired range of fastener sizes and should not be so wide as to adversely effect movements of the belt member. Like the projection 18, the projection 48 may likewise be constructed of a magnetized material to further aid in maintaining the fastener member in proper position engaged with the surface 50.

Figure 10:
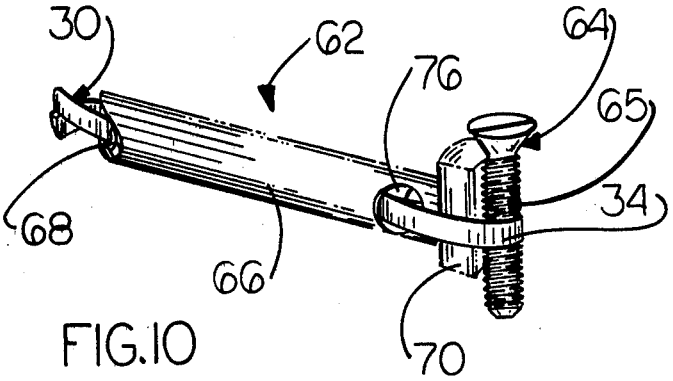
Figure 9:
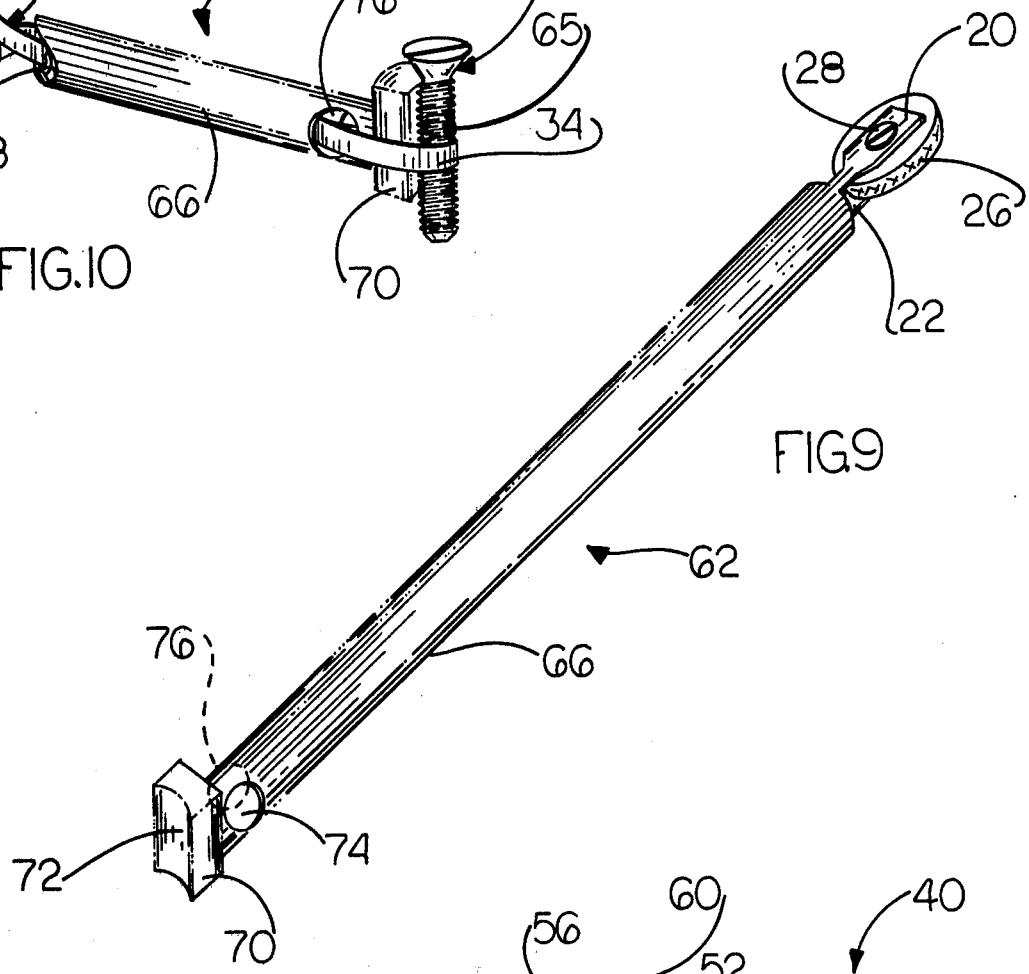
FIG. 9 is a perspective view of still another embodiment of the present tool device; and, FIG. 10 is a fragmentary perspective view illustrating operation of the tool device of FIG. 9.

FIGS. 9 and 10 disclose still another embodiment 62 of the present tool device utilizing still other means for rotatably supporting and holding a fastener such as the fastener 64 (FIG. 10). The embodiment 62 is adaptable for holding and retaining both screws and bolts and includes an elongated tubular member 66 having an opening or passageway 68 extending therethrough and a transverse member 70 mounted on one end portion thereof as shown in FIGS. 9 and 10. The member 70 is attached to the end portion of the member 66 by any suitable means such as by welding, soldering or any other joinder means and includes a recessed end facing surface 72 against which a screw or bolt is positioned when in use. The end surface 72 is concaved or otherwise rounded so as to allow the fastener 64 to freely rotate thereagainst when the bolt is moved as is true when the device is being used. The opposite end portion of the member 66 including the wheel member such as the wheel member 26 may be constructed and arranged similarly to corresponding portions of the tool 10 shown in FIGS. 1 and 2.

Unlike the tubular members 12 and 42 of the previous constructions which are open ended, the member 70 closes one end of the tubular member 66 so that it is necessary to have opposed openings 74 and 76 formed in opposite sides thereof near the end where the member 70 is attached so that the belt member 30 can extend outwardly through the openings and around a fastener positioned against the concaved end surface 72 as clearly shown. The rest of the belt extends through the tubular member 66 and out of the opposite or rear end for engagement with a wheel member such as the wheel member 26. So long as a sufficient tension is maintained on the belt 30 the fastener 64 will be held against the surface 72 and rotated when the belt is moved. Because the tubular member 66 is closed at one end by the member 70, installation of an endless belt in the embodiment 62 may be achieved by first inserting an open ended belt member through the opposed openings 74 and 76 and through the open end or rear portion of the member 66 and thereafter joining together the opposite end portions of the open ended belt such as by stitching, gluing, or any other suitable means.

As previously stated, the various embodiments of the subject tool can be dimensioned and constructed so as to accommodate any desired nut or bolt size or range of sizes, and the tubular body portion of the subject device can be made straight, formed at an angle, or even curved within limits, and it is also anticipated that the nut or bolt communicating portion and at least a portion of the tubular body member such as the members 12, 42 and 66 can be constructed of a flexible material to further facilitate use in relatively inaccessible areas. In addition, all embodiments of the subject device can be placed in operative engagement with a nut, bolt, or other fastener member located in a hard to reach place thereby allowing the user to manipulate the device to achieve accessibility to the particular fastener member involved and to remove it while still holding onto it. However, as previously indicated, the subject device is not desired to finally torque a nut or bolt into its final position or to loosen a torqued nut or bolt. The final torquing and/or untorquing will be accomplished with some other wrench tool. Although it is preferred that an endless belt such as the belt 30 (FIG. 3) be used on the subject device, an open ended belt of suitable length can also be utilized in which case the ends of the belt will extend from the rear end portion of the tubular member for engagement with opposite sides of the wheel member 26. An open ended belt may have some advantages in installing the belt on the subject tool especially if the wheel member 26 is mounted between spaced flanges such as the flanges 20 and 22, or the tubular member is constructed with a closed end as shown in FIGS. 9 and 10.

Thus there has been shown and described a novel tool for starting and/or loosening threaded fastener members, particularly those located in relatively inaccessible places, which tool fulfills all of the objects and advantages sought therefor. Many changes, modifications, variations and other uses and applications of the present construction will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A tool having particular utility for supporting for rotation threaded members to be installed or removed from relatively inaccessible locations comprising an elongated body member having first and second opposite end portions and a passageway extending therebetween, each of said first and second end portions having an opening therethrough communicating with the passageway extending through said body member, a flange member extending endwardly from said first end portion, said flange member having a sidewardly extending projection thereon in position to rotatably hold and support a threaded member when positioned thereon or therearound, a rotatable member and means extending endwardly from the second end portion of said body member for mounting the rotatable member thereon, an elongated endless flexible member extending through the passageway and through the opening associated with said second end portion and having portions thereof extending endwardly beyond said second end portion for tangential engagement with opposite sides of the rotatable member, said endless flexible member having another portion extending endwardly through the opening associated with the first end portion of said body member and around said sidewardly extending projection for engagement with a threaded member rotatably positioned in communication with said projection, rotation of said rotatable member when the endless flexible member is engaged with the opposite sides thereof providing the means for controllably tensioning and moving the flexible member longitudinally through said body member thereby imparting rotational movement to said threaded member.

2. The tool defined in claim 1 wherein said projection includes magnetic means.

3. The tool defined in claim 1 wherein said means extending endwardly beyond the second end portion for mounting the rotatable member thereon includes at least one flange member.

4. A tool for use in supporting and turning threaded members comprising an elongated body member having first and second opposite end portions and a passageway extending therebetween, said first and second end portions each having an aperture extending respectively therethrough communicating with the passageway extending through said body member, a flange portion extending endwardly from said first end portion having a laterally extending projection positioned thereon, said projection being dimensioned to rotatably hold and support a threaded member positioned thereon or therearound, a pair of spaced opposed flange members extending endwardly from said second end portion defining a channel therebetween communicating with the passageway formed within said body member, a rotatable member mounted in said channel between said spaced opposed flange members, a continuous flexible belt member of suitable length positioned in the passageway of said body member and extending through the respective apertures associated with said first and second end portions, said continuous flexible belt member having one end portion extending from and beyond the first end portion of said body member and around said laterally extending projection for engagement with the threaded member rotatably held by said projection, said flexible belt member having its opposite end portion extending endwardly from and beyond the second end portion of said body member and positioned to engage the opposite sides of said rotatable member, rotation of said rotatable member when said continuous belt member is engaged with the opposite sides thereof and is drawn taut around the threaded member moving reaches of the belt member that extend through the passageway in opposite directions thereby imparting rotational movement to said threaded member.

5. The tool defined in claims 1 or 4 wherein said elongated body member is tubular in shape.

6. The tool defined in claim 4 wherein said endwardly extending flange portion and said pair of spaced opposed flange members are integrally formed with the respective end portions of said body member.

7. A tool having particular utility for supporting for rotation threaded members to be installed or removed from relatively inaccessible locations comprising an elongated member and a flange portion extending endwardly from one end portion thereof, said flange portion including a shaped projection extending sidewardly therefrom, said shaped projection having an endwardly facing surface concavely shaped in two planar directions for rotatably receiving and supporting a threaded member positioned thereagainst, a rotatable wheel member and means extending endwardly from the opposite end portion of said elongated member for rotatably mounting said wheel member, a continuous flexible member and means associated with said elongated member for supporting the flexible member therealong such that the opposite end portions of said flexible member extend respectively from and beyond both opposite ends of said elongated member, one end portion of said flexible member being positioned to extend around a threaded member positioned against said shaped projection, the opposite end portion of said flexible member being positioned to be moved into engagement with respective opposite sides of the rotatable wheel member, rotation of said wheel member when the flexible member is engaged therewith and is drawn taut around the threaded member imparting a rotational movement to the threaded member.

8. The tool defined in claims 4 or 7 wherein said flexible member includes at least one surface having high friction gripping means thereon for engagement with the threaded member to facilitate the rotational movement thereof.

9. The tool defined in claims 4 or 7 wherein said flexible member is made of a rubberized material.

10. The tool defined in claim 7 wherein said wheel member has a knurled peripheral surface for engagement with the flexible member.

11. A tool for use in supporting and turning threaded fastener members comprising an elongated housing structure having first and second opposite end portions and a passageway extending therebetween, a transverse member mounted adjacent to said first end portion, said transverse member having a concaved endwardly facing surface adaptable for cooperatively receiving and rotatably supporting the threaded portion of a fastener member positioned thereagainst, said second end portion having an opening therethrough communicating with the passageway extending through said housing structure, a rotatable member and means extending endwardly from the second end portion of said housing structure for rotatably mounting the rotatable member, a flexible member positioned extending through the passageway of said housing structure and having a portion thereof extending endwardly through and beyond said second end portion, a pair of spaced opposed openings positioned adjacent to the first end portion of said housing structure through which and from which the opposite end portion of said flexible member extends for engagement with a threaded fastener member being supported by said transverse member, the portion of said flexible member extending from the second end portion of said housing structure being positioned to engage opposite sides of said rotatable member, rotation of the rotatable member when said flexible member is engaged with the opposite sides thereof and is drawn taut around the threaded portion of the fastener member moving the flexible member longitudinally through said housing structure and imparting rotational movement to the threaded fastener member engaged therewith.

* * * * *

UNITED STATES PATENT OFFICE

CERTIFICATE OF CORRECTION

Patent No. 4,436,003 Dated March 13, 1984

Inventor(s) Raymond G. Cox

It is certified that error appears in the above-identified patent and that said Letters Patent are hereby corrected as shown below:

Column 6, line 21, "Since" should be --Once--.

Column 7, line 53, "into" should be --in--.

Column 8, line 41, "bolt" should be --belt--.

Column 9, line 18, "desired" should be --designed--.

Signed and Sealed this

*Nineteenth* Day of *June 1984*

[SEAL]

*Attest:*

GERALD J. MOSSINGHOFF

*Attesting Officer*

*Commissioner of Patents and Trademarks*